US006154964A

United States Patent [19]

Tally

[11] Patent Number: 6,154,964

[45] **Date of Patent: *Dec. 5, 2000**

[54] TUBE CUTTING TOOL

[75] Inventor: Kevin L. Tally, Clarinda, Iowa

[73] Assignee: Lisle Corporation, Clarinda, Iowa

[ * ] Notice: This patent is subject to a terminal disclaimer.

[21] Appl. No.: 09/274,155

[22] Filed: Mar. 22, 1999

Related U.S. Application Data

[63] Continuation-in-part of application No. 09/058,480, Apr. 10, 1998, Pat. No. 5,987,750.

[51] Int. Cl.[7] ..... B26B 13/00

[52] U.S. Cl. ..... 30/92; 30/94; 30/108; 30/134; 30/252; 30/254; 30/260; 30/341; 81/416

[58] Field of Search ..... 30/92, 94, 108, 30/131, 134, 249, 250, 252, 254, 260, 340, 341, 363; 81/416, 417

[56] References Cited

U.S. PATENT DOCUMENTS

| | | | |
|---|---|---|---|
| 4,336,652 | 6/1982 | Robertson | 30/92 |
| 4,412,380 | 11/1983 | Kish | 30/92 |
| 4,785,538 | 11/1988 | Meyer | 30/92 |
| 4,872,455 | 10/1989 | Pinchuk et al. | 30/92 |
| 5,012,579 | 5/1991 | Matsumoto | 30/92 |
| 5,197,879 | 3/1993 | Fowler, II et al. | 81/416 |
| 5,987,750 | 11/1999 | Tally | 30/92 |

FOREIGN PATENT DOCUMENTS 1178426 11/1984 Canada .

OTHER PUBLICATIONS

MAC Tools, 1990 catalog, p. 269, DG1000 Multi–Cutter.
Matco Tools, 96/97 catalog, p. 173 HC14 Hose and Cable Cutter.
Snap–On Tools, 1995 catalog, p. E63, A174CP Hose Clamp Cutter; YA1000 Multi–Cutter; PWC60 Compound Leverage Hose Cutter.

*Primary Examiner*—M. Rachuba
*Attorney, Agent, or Firm*—Banner & Witcoff

[57] ABSTRACT

A hose cutter tool includes scissor arms joined at a pivot point having opposed jaws, one of which includes a cutter blade and the other of which defines an arcuate support surface to hold tubing material. As the arms are manipulated, the blade descends through and cuts the tubing material.

4 Claims, 5 Drawing Sheets

TUBE CUTTING TOOL

CROSS REFERENCE TO A RELATED APPLICATION

This is a continuation-in-part of application Ser. No. 09/058,480 filed Apr. 10, 1998 now U.S. Pat. No. 5,987,750.

BACKGROUND OF THE INVENTION

This invention relates to a device for cutting tubing and the like, and more particularly, to a device which includes arm members that are connected to operate with a scissors action and include jaws that facilitate positioning of a tube appropriately for proper engagement by a jaw mounted blade that cuts the tube.

Canadian Patent No. 1,178,426 discloses a scissors type tube cutter which includes a pair of opposed jaws. One jaw has a v-shaped tube support surface which positions a tube for engagement by a blade held by the other jaw. Importantly, the blade is offset from the center line of the v-shaped tube holding jaw to insure a slicing stroke by the blade against a tube positioned by the v-shaped support surface. The device disclosed has been commercialized and is useful. However, there has remained the need to provide an improved tube or hose cutter, especially for use in the automotive repair field. The present invention is directed to such an improved tube or hose cutter.

SUMMARY OF THE INVENTION

Briefly, the present invention comprises a hose cutter tool which includes first and second arm members joined at a central pivot connection. The arm members each include a handle at one end and a jaw at the opposite end. Manual manipulation of the handles causes the jaws to move from an open position toward one another to a closed position. One of the jaws includes a cutting blade which has a point defined by cutting edges that converge to form the point. The blade lies in the plane defined by the scissors action movement of the jaws. The other of the jaws includes a smoothly curved hose support surface, generally transverse to the plane defined by the cutting blade. The curved surface defines a bisector line and the point of the blade intersects that bisector line upon closure of the jaws. Jaw closure drives the blade against tubing supported on one jaw and cuts a material supported in the curved support surface. The arms are joined at a pivot connection which includes radially spaced, arcuate ribs that engage in compatible slots.

Thus it is an object of the invention to provide an improved tube or hose cutter.

It is a further object of the invention to provide an improved hose cutter which has a scissors-type action and includes a removable cutting blade.

Yet a further object of the invention is to provide a hose cutter wherein the hose or tubing to be cut is supported on a curved surface having a midpoint line, or bisector line, and the curved surface shaped so as to substantially center the hose or tube on the bisector line as it is cut.

Yet a further object of the invention is to provide a hose or tube cutter wherein the cutting blade is removable or replaceable and is symmetrical as well as reversible.

Another object of the invention is to provide a hose cutting tool having a pliers type construction and operation wherein a pivot connection for the handles effectively and efficiently supports a load.

These and other objects, advantages and features of the invention will be set forth in the detailed description which follows.

BRIEF DESCRIPTION OF THE DRAWING

In the detailed description which follows, reference will be made to the drawing, comprised of the following figures.

DESCRIPTION OF THE PREFERRED EMBODIMENT

Figure 1:
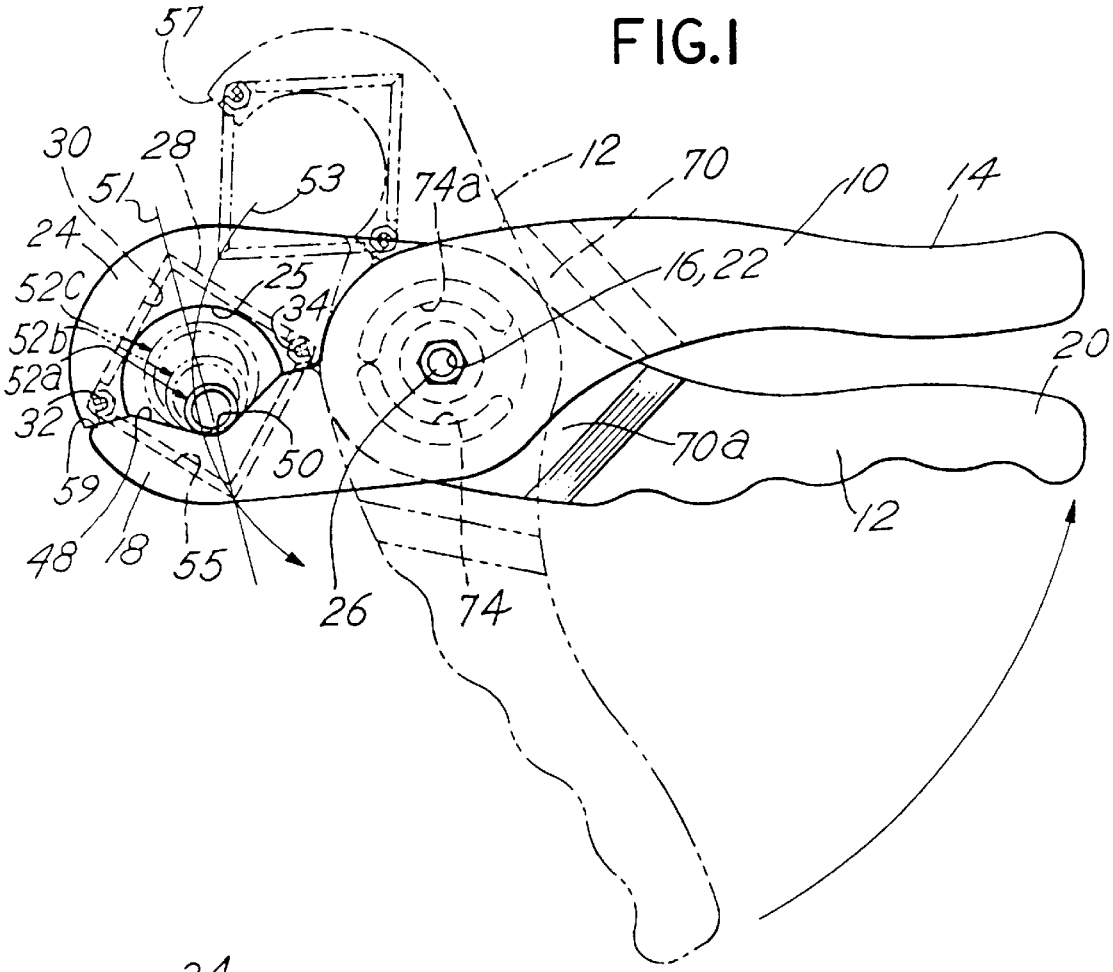
FIG. 1 is a side elevation of the improved hose or tube cutter of the invention.
Figure 2:
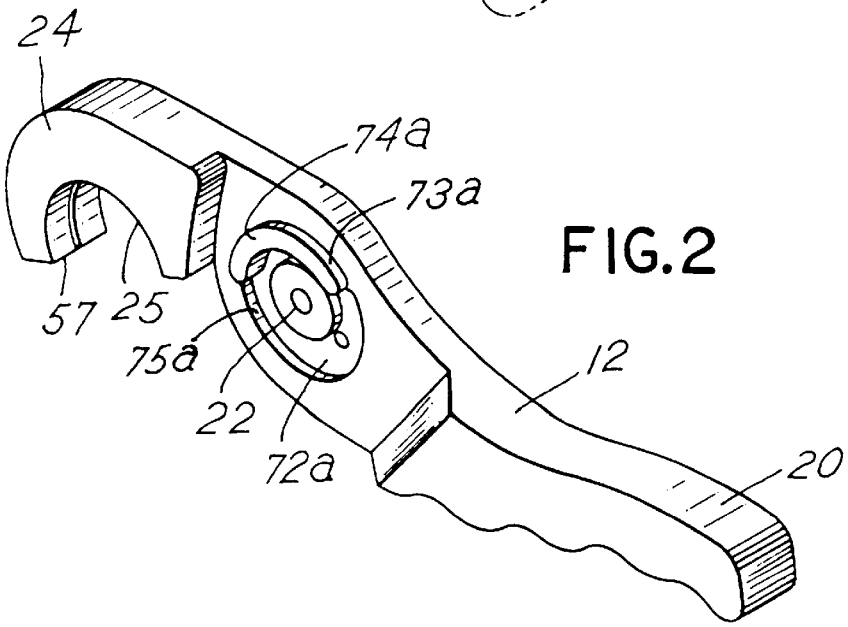
FIG. 2 is a perspective view of one arm of the cutter of FIG. 1.

Referring to the figures, the tube or hose cutter of the invention includes a first arm member 10 and a second arm member 12. The first arm member 10 includes a handle 14 at one end, an intermediate pivot opening 16, and a lower jaw 18 at the opposite end. The second arm 12 likewise includes a handle 20 at one end, an intermediate pivot opening 22, and an upper jaw 24 at the opposite end. The handles 10 and 12 are joined together for pivotal, or scissors-type action, by a pin 26 extending through the pivot openings 16, 22. The handles 14 and 20 may or may not include grips, such as molded rubber grips. The handles 14 and 20 operate in a scissors-type manner. Thus. as the handles 14, 20 approach one another due to manual manipulation, the jaws 18 and 24 also will approach one another.

The upper or top jaw 24 includes an arcuate or curved surface 25. A blade 28 is mounted in a slot 30 in the upper jaw 24. The blade 28 may be diamond shaped or rectangular and is retained by retainer pins or screws such as pins 32 and 34 in the upper jaw 24. The blade 28 thus includes small detents 36 and 38 which cooperate with the pins 32 and 34 respectively. The blade 28 may be reversible. That is, either opposite point may project from slot 30 to pierce a hose.

The blade 28 includes a point 42 and cutting edges 44 and 46 which diverge in opposite directions from the point 42. The edges 44, 46 are sharpened and the point 42 is also sharpened. The edges 44 and 46 may be symmetric as depicted, or asymmetric. The symmetric configuration is preferred.

Figure 10:
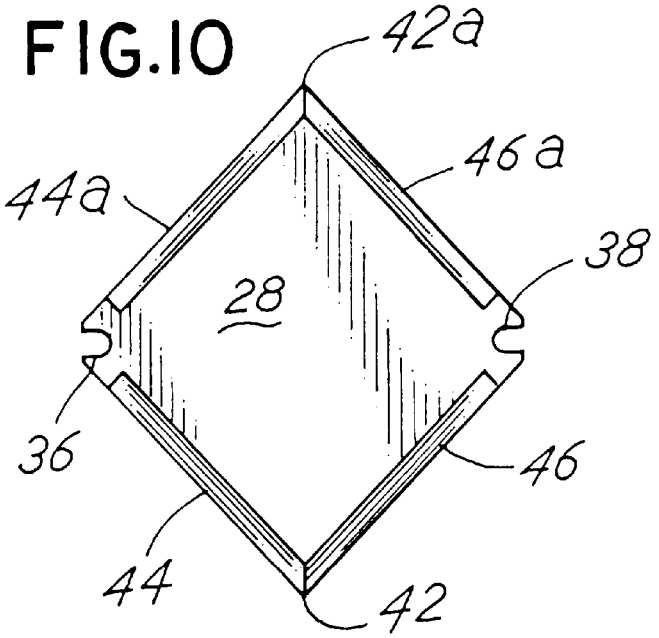
FIG. 10 is a plan view of a typical blade utilized in the practice of the invention.
Figure 11:
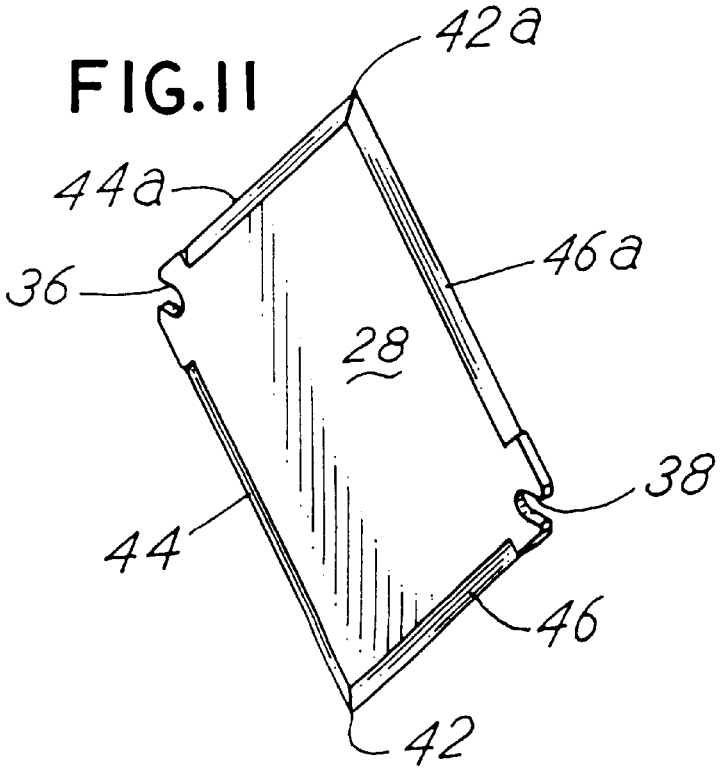
FIG. 11 is a perspective view of the blade construction.

In the preferred embodiment, the blade 28 is symmetric. That is, the blade 28 is generally square or diamond shaped and, for example, two sides 44, 46 of the blade 28 may define 85° angles, one with respect to the other, as depicted in FIG. 10. The edges or sides 44, 46 are thus at a right angle or an acute angle, one with respect to the other, and the edges 44 and 46 are sharped and converge to the point 42. On the opposite side of the blade 28, a point 42*a* is defined by converging edges or sides 44*a* and 46*a*. Again, the sides 44*a* and 46*a* may converge at a 90° angle or some other angle, most normally, an acute angle, e.g. 85°. The juncture of the edges 44 and 44*a* includes a passageway or slot 36, and the convergence of the edges or sides 46 and 46*a* also defines a slot detent or opening 38. Note that with the design described, the blade 28 may be reversed so that the point 42*a*, rather than the point 42, is engagable with a tube retained by the hose cutter. Further, the slots or detents 36 and 38 may be reversed to cooperate with fasteners 32 and 34, or 34 and 32.

The lower jaw 18 includes a curved tube or hose support surface 48 which is generally transverse to the plane defined by The blade 28 as the blade 28 moves toward the surface 48. The surface 48 has a midpoint 50 and a slot 55 for receipt of blade 28 as the jaws 18, 24 close. The surface 48 may, for example, comprise a portion of a cylindrical surface, a portion of an elliptical surface, or a portion of some other curved surface. In each event, the curved surface 48 will include a mid point 50. The midpoint 50 lies on a bisector 51. The surface 48 is preferably configured to position the center of a tube 52 on the bisector 51.

In FIG. 1 depicting the jaws 18, 24 and arms 10, 12 of the tube cutter, an outline of the outer diameter of various sizes of tubes 52*a*, 52*b*, 52*c* lying on the surface 48 is depicted. Note that the tubes 52*a*, 52*b*, 52*c* include centers which lie on the bisector 5 1. This alignment is achieved by choice of the shape of the curved surface 48 to appropriately align tubes 52 thereon. As the upper jaw 24 is closed, the upper jaw 24 will transfer the blade 28, and more particularly, the point 42 of the blade 28 along a path which is arcuate and is defined by the arc 53. The arc 53 passes through the bisector 51 as the jaw 18 is closed and moves toward the lower jaw 18. The point 42 of the blade 28 thus pierces a tube 52 and the sharpened edges 44, 46 shear the tube 52 retained on the surface 48. The point 42 then passes through a pathway which, when the jaws 18 and 24 are fully closed, positions the point 42 on the bisector 51, again as depicted in the figures. The point 42, thus, is designed to pass through tubing and may, in fact, pass on both sides of the bisector 51 as the blade 28 passes through or shears tubing 52.

The slot 55, into which the blade 28 is positioned as the jaws 18 and 24 close, is sufficiently deep so that the blade 28 does not engage with or contact the sides of the slot 55 in the preferred embodiment. Rather, the upper jaw 24 includes a contact surface 57 which engages with a counterpart contact surface 59 of the lower jaw 18 to limit the scissors or pivotal movement of the jaws 18 and 24. The forces on the blade 28 thus do not impinge on any of the cutting edges 44, 44*a*, 46 and 46*a* inasmuch as the pins or lugs 32 and 34 serve as the means for retaining the blade in the upper jaw 24 and for transferring adequate cutting force from the upper jaw 24 to the blade 28. Thus, the upper jaw 24 also includes slot 30 for receipt of the blade 28. Again, the slot 30 does not limit the motion or position of the blade 28 and consequently does not cause the edges 44*a* and 46*a* to become dulled. Rather, the slot 30 defines a means for aligning and appropriately positioning the blade 28 and further provides a safety feature inasmuch as if one of the pins 32 or 34 should fracture or break, the slot 30 will tend to hold the blade 28 in position.

The tool is designed so that as the blade 28 moves to the closed position, it intersects the bisector 51 of the curved surface 48. In this manner, a hose or tube 52 which is retained between the blade 28 and the curved surface 48 will receive a positive cutting action of the blade 28. The preferred construction of the blade 28 is to have straight edges 44, 46 although curved edges 44, 46 may be utilized.

The curved surface 48 will typically have a uniform radius of curvature though again as expressed above, other curved shapes may be utilized. The blade 28 may be permanently affixed or removable from the jaw 24. Note that the upper jaw 24 includes the curved surface 25 so that as the blade 28 impinges and cuts through a hose such as hose 52, the jaw 24 will not interfere with the hose 52 and will not compress the hose 52. That is, the blade 28 will effect the shearing action through the hose.

The arms 10 and 12 have a pivot connection assembly cast or molded therein which facilitates the interrelationship of the separate arms 10 and 12, may limit the pivotal motion thereof, and enhances the cooperative engagement of the arms 10 and 12. Thus, referring to the figures, and in particular, the figures associated with the arm 10, the arm 10 includes a recess 70 which is compatible with a similar recess 70*a* associated with the arm 12. The recess 70 includes a partial circular arcuate cavity or counterbore 72 and a partial circular arcuate projecting rib 74 which has the same radial extent as the cavity 72. The arm 12 includes a similar radial rib 74*a* which is positioned on or within to fit within the arcuate cavity or recess 72. The arcuate rib 74 thus fits into a compatible cavity 72*a* of arm 12.

The ribs 74 and 74*a* have an arcuate length less than 180° which may provide, in combination, a means for limiting and controlling the extent that the arms 10 and 12, and more particularly, the jaws 18 and 24 can be opened. The arcuate ribs 74, 74*a* also are slidable in their associated cavities 72 and 72*a* to permit the jaws 18 and 24 to be fully closed, as depicted in the figures. That is, the ends 57, 59 of the jaws 18, 24 will engage to limit the pivotal movement of the arms 10 and 12 with respect to one another.

In a preferred embodiment, the arcuate ribs 74, 74*a* do not limit rotational movement of the arms about pivot 26. Rather, the ribs 74, 74*a*, respectively, fit within the arcuate counterbore cavities 72, 72*a* of the opposed handle or arm 10, 12. The ribs 74, 74*a* each have a partial cylindrical outer surface 73, 73*a*, which is slidably engaged against a congruent surface 75, 75*a* defined in each counterbore 72, 72*a*. Thus, the handles or arms 10, 12 rotate with respect to each other about the axis of pivot pin 26, but the load or bearing forces placed on the tool are borne by the interaction of the ribs 74, 74*a* and counterbores 72, 72*a*. Note the ribs 74, 74*a* and counterbores 72, 72*a* are equally radially spaced from the center of pivot or pin 26.

Figure 1A:
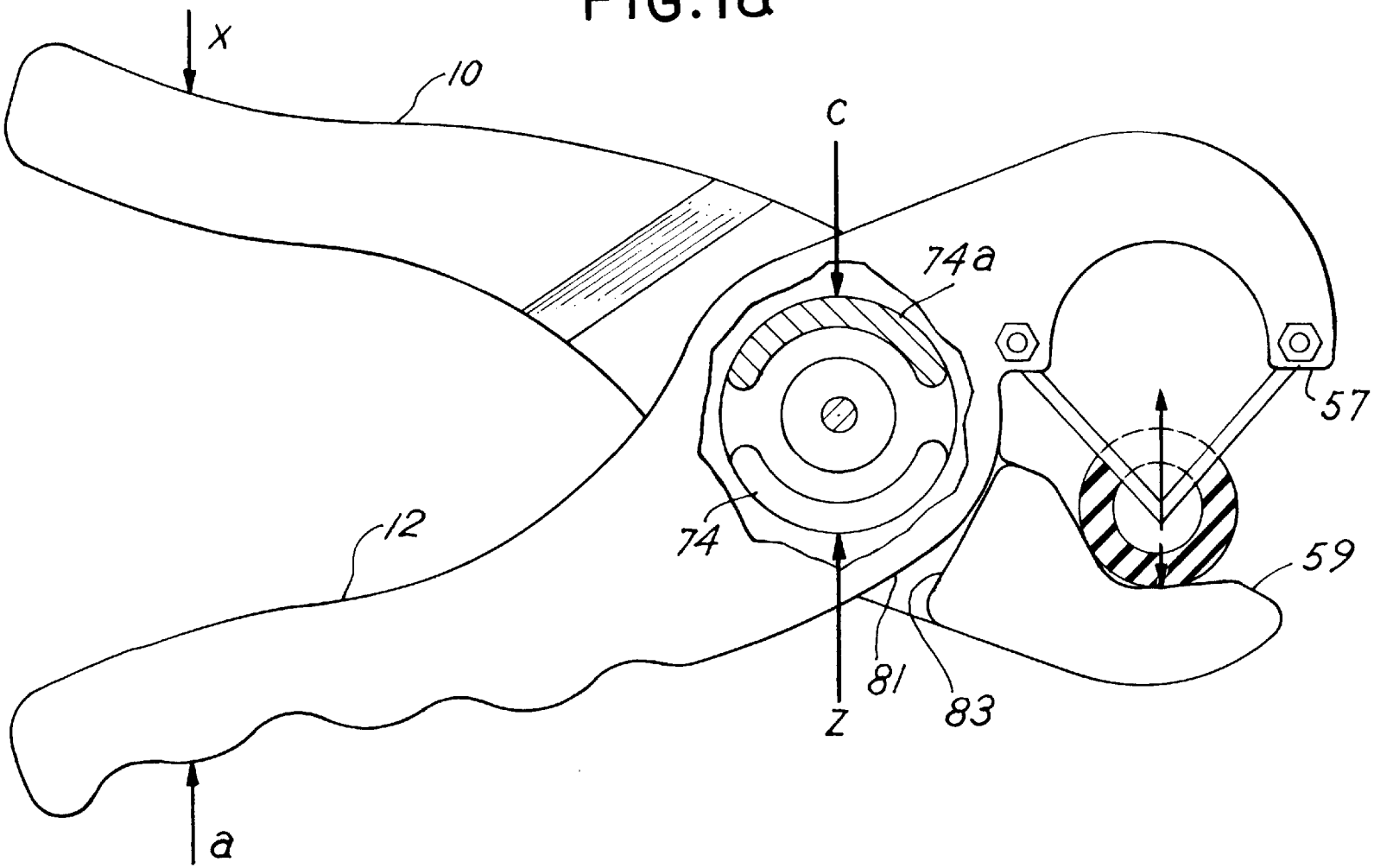
FIG. 1*a* is a side elevation of the assembled tool of the invention indicating the distribution of forces of the component parts of the tool.
Figure 3:
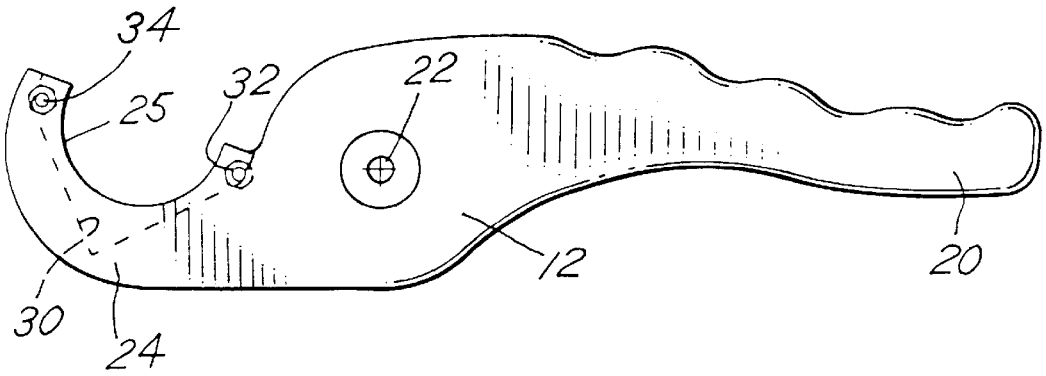
FIG. 3 is an outside elevation of the arm of FIG. 2.
Figure 4:
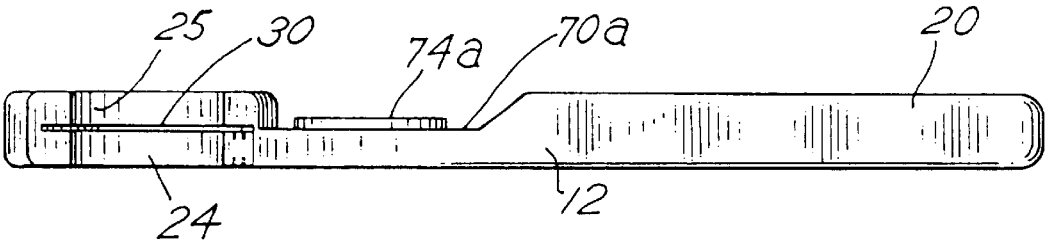
FIG. 4 is a top plan view of the arm of FIG. 2.
Figure 5:
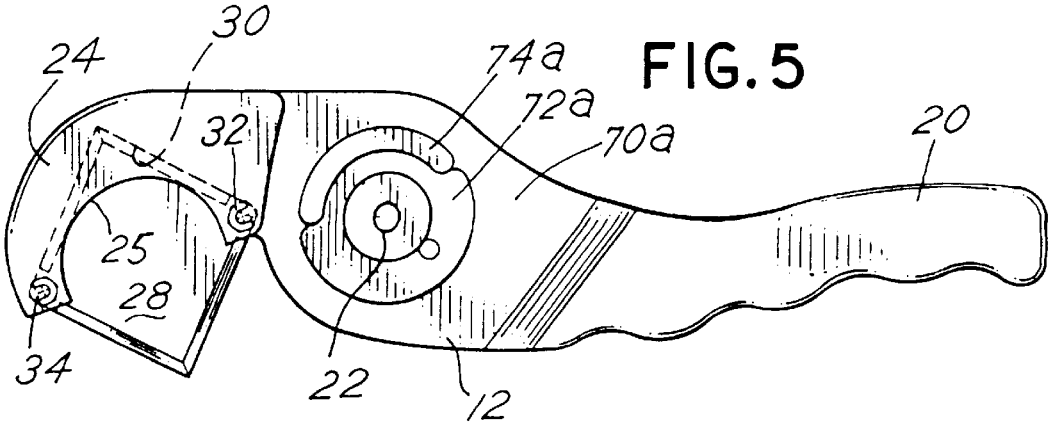
FIG. 5 is an inside elevation of the arm of FIG. 2.
Figure 6:
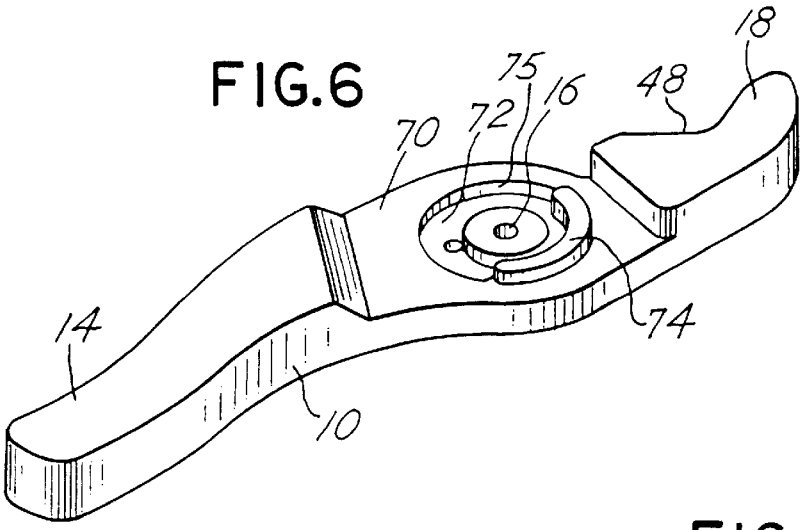
FIG. 6 is a perspective view similar to FIG. 2 depicting the other arm of the cutter.
Figure 7:
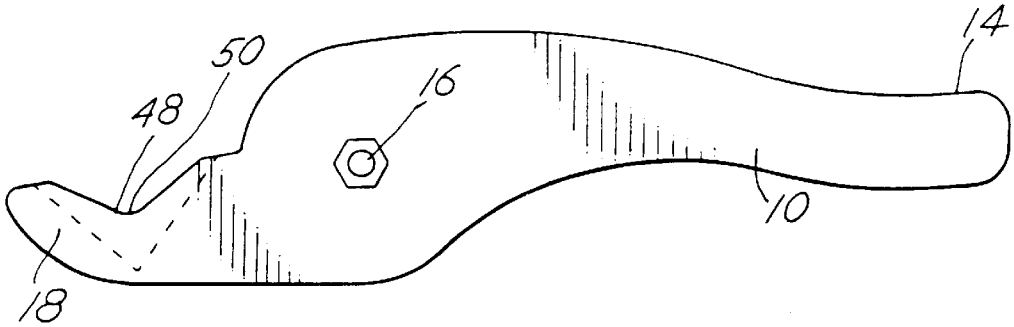
FIG. 7 is an outside elevation of the arm of FIG. 6.
Figure 8:
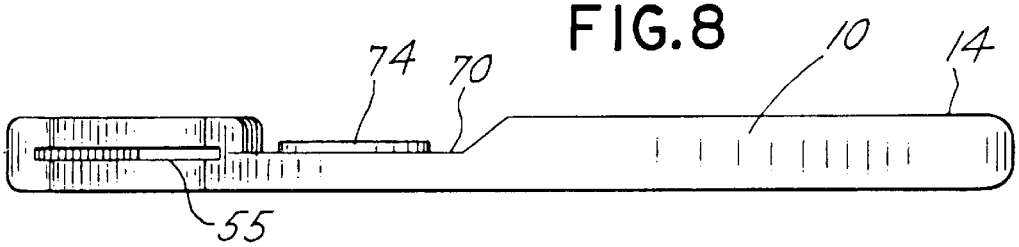
FIG. 8 is a top plan view of the arm of FIG. 6.
Figure 9:
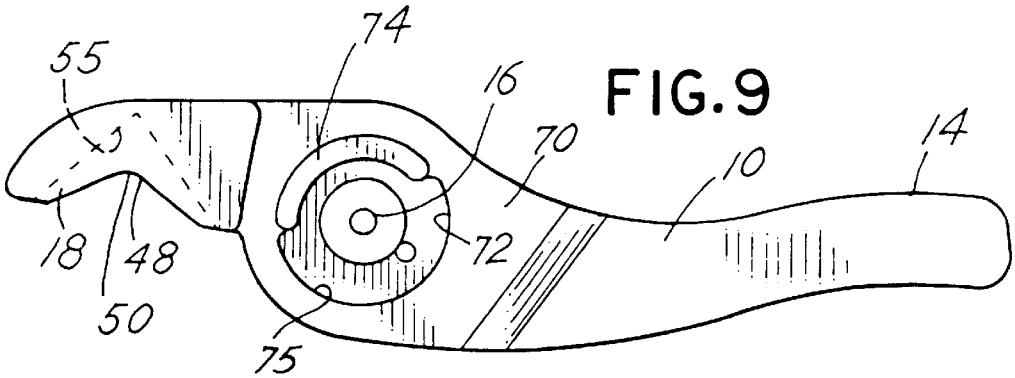
FIG. 9 is an inside elevation of the arm of FIG. 6.

Because the area of engagement of these elements is greater than the area of the pivot pin 26, the load on the pin 26 is eliminated substantially and dispersed over the greater area defined by arcuate, cylindrical surfaces 73, 73*a*. FIG. 1A illustrates the summation of forces on the surfaces 73, 73*a*. Vector sums a plus b equal c and x plus y equal z in the figure.

The movement of jaws and handles in the open direction is limited by surfaces 81, 83 as depicted in FIG. 1A. As stated herein, the closure of the jaws is limited by the engagement of their ends 57, 59. The ribs 74, 74*a* and counterbores 72, 72*a* project transversely from the opposed surfaces of the pivot connection assembly essentially as mirror images of each other thus enabling easy assembly and disassembly of the tool without movement of the handles about pivot 26 to any special position.

In practice, the arms 10 and 12 may be manufactured from a glass filled nylon material. By way of example, a 30% glass filled nylon material may be molded in a manner which will provide for appropriate strength to effect a cutting operation, yet will be sufficiently economical and capable of easy assembly. The arcuate extent of the cavities 72 and 72*a* is typically greater than 180° to avoid limiting travel of the respective rib 74 or 74*a* located therein.

Other variations to the construction are possible. The shape of the blade and the particular curvature of the lower jaw 24 may be altered, for example. The dimension, radial position and circumferential extent of ribs 72, 72*a* and recesses 74, 74*a* may be varied. Thus the invention is to be limited only by the following claims and equivalents thereof.

What is claimed is:

1. A hose cutter tool comprising, in combination:

first and second aim members, each member including a handle, a working jaw and a pivot construction intermediate the handle and jaw for connecting the arm members to permit scissors action of the jaws in response to manipulation of the handles, one of said jaws including a cutting blade, said blade comprising a cutting point and cutting edges on the opposite sides of the point, said edges converging to the point, said blade lying in a plane defined by the scissors action of the jaws;

the other of said jaws including a smoothly curved support surface with a bisector line, said support surface generally transverse to the plane defined by the blade, said curved surface having a slot for receipt of the blade, said blade point entering the slot upon closure of the jaws to cut material supported by the curved support surface; and said pivot connection including a center pivot pin defining a pivot axis and further including each handle having opposed circular, arcuate ribs in a circular, arcuate slot, each rib and slot defining opposed engaging support surfaces.

2. The tool of claim 1 wherein the blade is removable from the jaw.

3. The tool of claim 1 wherein the blade is symmetric about the point.

4. The tool of claim 1 wherein the blade is four sided with a pair of sides converging to a point.

* * * * *